United States Patent [19]

Kennedy, Jr.

[11] Patent Number: 4,637,899

[45] Date of Patent: Jan. 20, 1987

[54] CORROSION INHIBITORS FOR CLEANING SOLUTIONS

[75] Inventor: Weldon C. Kennedy, Jr., Tulsa, Okla.

[73] Assignee: Dowell Schlumberger Incorporated, Tulsa, Okla.

[21] Appl. No.: 574,837

[22] Filed: Jan. 30, 1984

[51] Int. Cl.[4] ..... C11D 7/32

[52] U.S. Cl. ..... 252/542; 252/82; 252/148; 252/149; 252/151; 252/391

[58] Field of Search ..... 252/82, 148, 149, 151, 252/391, 394, 542

[56] References Cited

U.S. PATENT DOCUMENTS

| | | | |
|---|---|---|---|
| Re. 30,283 | 5/1980 | Frenier et al. | 252/151 |
| Re. 30,714 | 8/1981 | Harriman et al. | 134/2 |
| Re. 30,796 | 11/1981 | Lesinski | 134/2 |
| 2,574,576 | 11/1951 | Marsh | 252/8.55 |
| 2,602,779 | 7/1952 | Moyer | 252/8.55 |
| 2,955,087 | 10/1960 | Elbreder et al. | 252/148 |
| 2,965,577 | 12/1960 | Heimann et al. | 252/148 |
| 3,037,937 | 6/1962 | Harris | 252/542 |
| 3,413,160 | 11/1968 | Teumac | 134/2 |
| 3,579,447 | 5/1971 | Muzyczko et al. | 252/82 |
| 3,619,125 | 11/1971 | Dorwancher et al. | 252/149 |
| 3,669,902 | 6/1972 | Hirner | 252/149 |
| 3,686,123 | 8/1972 | Hiroshi | 252/82 |
| 3,764,543 | 10/1973 | Frenier et al. | 252/151 |
| 3,819,527 | 6/1974 | Hayman, Jr. | 252/148 |
| 3,996,147 | 12/1976 | Settineri et al. | 252/149 |
| 4,057,390 | 11/1977 | Quinlan | 422/12 |
| 4,071,746 | 1/1978 | Quinlan | 252/392 |
| 4,100,099 | 7/1978 | Asperger et al. | 252/391 |
| 4,100,160 | 7/1978 | Clouse et al. | 252/189 |
| 4,102,804 | 7/1978 | Clouse et al. | 252/391 |
| 4,210,552 | 7/1980 | Frenier et al. | 252/151 |
| 4,220,550 | 9/1980 | Frenier et al. | 252/180 |
| 4,443,268 | 4/1984 | Cook | 134/2 |
| 4,450,102 | 5/1984 | Lindstrom et al. | 252/542 |

FOREIGN PATENT DOCUMENTS 1138463 12/1982 Canada .

OTHER PUBLICATIONS

Frignani, A. et al., On the Inhibitive Action of Some N-Decyl-pyridinium Bromide Derivatives on the Iron Dissolution in 1N Hydrochloric Solutions; presented at 5th European Symposium on Corrosion Inhibitors, Sep. 15–19, 1980, at Ferrara, Italy.

Jofa, Z. A., Adsorption of Inhibitors of the Acid Corrosion of Iron & the Mechanism of their Action, presented at 2nd European Symposium on Corrosion Inhibitors, Sep. 22–24, 1965, at Ferrara, Italy.

*Primary Examiner*—Paul Lieberman
*Assistant Examiner*—Willie J. Thompson
*Attorney, Agent, or Firm*—L. Wayne White

[57] ABSTRACT

A corrosion inhibitor composition comprising:

(1) at least one of an aliphatic pyridinium salt or an aliphatic quinolinium salt; and (2) a sulfur-containing compound. The compositions are useful in inhibiting the corrosion of metals during the cleaning of process equipment using industrial aqueous cleaning solutions.

22 Claims, No Drawings

CORROSION INHIBITORS FOR CLEANING SOLUTIONS

BACKGROUND OF THE INVENTION

The present invention relates to metal-cleaning compositions which are inhibited against corrosion. Further, the invention relates to a method of using said compositions to chemically clean oxide scale from metal surfaces.

In almost any type of metal equipment in which water is evaporated or heat transfer occurs, insoluble salts deposit on the surfaces to form scale. Usually, the deposits consist of calcium and magnesium salts and result from the use of hard water, although sometimes the scale is based on elements other than calcium or magnesium. Common types of scale which deposit on metal surfaces include calcium sulfate, calcium carbonate, complex calcium phosphate, and calcium oxylate. Additionally, high iron content scales, such as magnetite or hematite, are also encountered. Scale or salt deposits reduce the heat transfer efficiency of the equipment in which they form. Therefore, it is desirable to remove scale and salt deposits from the metal surfaces of heat transfer equipment systems.

The art of cleaning steam boilers and associated piping and vessels has progressed from the use of highly acidic solutions for the dissolution of hard water scale and rust or magnetite to the current use of materials which complex iron or calcium and magnesium as well. Solutions of complexing agents do not rely on mineral acids to accomplish scale loosening or dissolution. In fact, many currently-used cleaning solutions are often made alkaline by the addition of ammonia. For example, see U.S. Pat. No. 3,413,160.

The cleaning solutions which are employed to remove the scale and rust from industrial process equipment, such as boilers and heat exchangers, typically are corrosive to the metal components of the equipment. Thus, the cleaning solutions usually contain corrosion inhibitors. Unfortunately, many corrosion inhibiting compositions are effective only at a specific pH or over a narrow pH range. Additionally, many corrosion inhibitor compositions are relatively insoluble in the cleaning solutions, and a solubilizing alcohol or a surfactant is required. For example, U.S. Pat. No. 4,071,746 discloses an "acid corrosion inhibiting composition" comprising a substituted benzyl pyridinium compound and an oxyalkylated surfactant or an alcohol.

In view of the deficiencies in the prior art compositions, it would be desirable to have a corrosion inhibiting composition which is soluble in effective amounts in concentrated cleaning solutions. Further, it would be desirable to have a corrosion inhibiting composition which could inhibit a large number of corrosive cleaning solutions over a wide pH range.

SUMMARY OF THE INVENTION

A corrosion inhibitor composition has now been discovered which is particularly effective in inhibiting the corrosion of metals due to the contact of aqueous, corrosive cleaning solutions. The corrosion inhibitor composition comprises:

(1) at least one of an aliphatic pyridinium salt or an aliphatic quinolinium salt; and (2) a sulfur-containing compound.

In another aspect, the present invention is a novel aqueous cleaning solution having dissolved or dispersed therein, in at least an amount sufficient to inhibit the corrosion of metals in contact with said solution, a corrosion inhibitor composition comprising:

(1) at least one of an aliphatic pyridinium salt or an aliphatic quinolinium salt; and (2) a sulfur-containing compound.

In yet another aspect, the present invention is a process of inhibiting the corrosion of metal surfaces which are in contact with a cleaning solution, the process comprising incorporating in the solution a small but corrosion-inhibiting amount of the corrosion inhibitor composition described hereinbefore.

In a further aspect, the present invention is a process for removing hardness scale and rust from a metal surface, comprising contacting said metal surface with an aqueous cleaning solution inhibited against corrosion with a corrosion-inhibiting composition described hereinbefore for a time sufficient to dissolve said hardness scale and rust.

Surprisingly, the corrosion inhibitor composition of the present invention provides protection over a wide pH range, is soluble in many cleaning solutions without the aid of an alcohol or a surfactant, and is effective at lower concentrations than are many known commercial corrosion inhibitor compositions which are employed in aqueous cleaning solutions.

DETAILED DESCRIPTION OF THE INVENTION

The corrosion inhibitor composition of the present invention includes (1) an aliphatic pyridinium or aliphatic quinolinium salt, and (2) a sulfur-containing compound.

The aliphatic pyridinium or quinolinium salt component of the corrosion inhibitor may bear substituents on the aromatic ring(s) or on the aliphatic moiety. Alkyl pyridinium salts are preferred. Preferred alkyl pyridinium salts are represented generally by the formula:

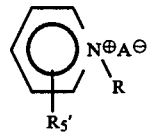

wherein R is alkyl; A⊖ is an anion; and each R' independently is a substituent such as, for example, H, —OH, —OR, —OROH, —COOR, alkyl, alkenyl, alkynyl or halo. Preferably, each R' moiety is hydrogen. Preferably, R is an alkyl moiety having from about 8 to about 18 carbon atoms. More preferably, R is an alkyl moiety having from about 10 to about 16 carbon atoms. Most preferably, R is dodecyl. A⊖ is a compatible anion. The choice of anion is not critical and may be varied to convenience. The anion may be selected by the method of preparing the quaternary salt or by ion exchange means. Examples of suitable anions include chloride, bromide, iodide, nitrate, $MeSO_4^-$, bisulfate, tosylate, acetate, benzoate, dihydrogen phosphate, and the like. Bromide is the preferred anion.

The sulfur-containing compound enhances the corrosion-inhibiting protection afforded by the aliphatic pyridinium or quinolinium salt component. Preferred sulfur-containing compounds include thiourea, thioacetamide, thionicotinamide, ammonium thiocyanate, and, generally speaking, compounds having a thioamide (—$CSNH_2$) moiety, and mixtures of these compounds. The most preferred sulfur-containing compounds are thiourea and ammonium thiocyanate. The sulfur-containing compound is employed in an amount which is sufficient to improve the protection afforded by the aliphatic pyridinium or quinolinium salt of the present invention. Typically, improved protection is achieved by including at least about 0.2 moles of the sulfur-containing compound per mole of the aliphatic pyridinium or quinolinium salt. The corrosion inhibitor composition of the present invention preferably includes from about 0.5 to about 2 moles of sulfur-containing compound per mole of the aliphatic pyridinium or quinolinium salt.

The known solubilizing alcohols and surfactants which are used with other inhibitor compositions also can be used with the present inhibitor composition. The alcohols include, for example, alkanols, alkenols, alkynols, glycols, polyols, and the like. Mixtures of alcohols may be employed. Examples of preferred alcohols include isopropanol and the monobutyl ether of ethylene glycol. Typically, the alcohol compound is employed in an amount ranging fromm about 0 to about 70 volume percent of the final corrosion inhibitor composition. The alcohols improve the solubility of the components in the inhibited cleaning solutions and also improve the handling properties of the final composition. Examples of such properties include freezing point and rate of dispersion or dissolution into the cleaning solution. A preferred embodiment of the present invention is a corrosion inhibitor composition containing at least one alcohol in an amount sufficient to prevent the corrosion inhibitor composition from freezing under conditions of storage and use.

It is also desirable, although not required, to employ a surfactant in the corrosion inhibitor composition of the present invention. Such surfactants can be used singly or as surfactant mixtures. Typical surfactants include nonionic surfactants such as, for example, ethoxylated nonyl phenols, alkyl aryl polyether alcohols, aliphatic polyether alcohols, alcohol ethoxysulfates, and alkyl sulfonated diphenyl oxides. When used, the surfactant is employed in an amount which aids the rate of dispersion or dissolution of the corrosion inhibitor composition into the concentrated cleaning solution. The surfactant preferably is employed in an amount which is from about 0 to about 20 volume percent, and most preferably from about 2 to about 7 volume percent, based on the volume of the final corrosion inhibitor composition.

The corrosion inhibitor of the present invention substantially prevents excessive corrosion of clean base metal during chemical cleaning operations. The corrosion inhibitor composition can be employed advantageously over a wide pH range in a wide number of cleaning solutions, such as those listed in Table I. For the purposes of the present invention, the term "cleaning solution" refers to an aqueous acidic or alkaline solution which is employed in the cleaning of metal surfaces, such as the metal internal surfaces of process equipment. A cleaning solution typically has a pH range in the range of from about 1 up to about 10. For example, Table I lists a number of cleaning solutions and their pH values.

TABLE I

| Cleaning Solution | Active Agent(s) | pH |
|---|---|---|
| A | HEDTA[1] | ≃2.3 |
| B | diammonium EDTA[2] | 5 |
| C | tetraamonium EDTA[2] | 9.2 |
| D | C + citric acid | 5 |
| E | C + formic acid | 5 |
| F | hydroxyacetic acid + formic acid | ≃2.2 |
| G | trisodium salt of B + $H_2SO_4$ | 1.2–1.5 |

[1]HEDTA is N—2-hydroxyethyl N,N',N'—ethylenediaminetriacetic acid
[2]EDTA is N,N,N',N'—ethylenediaminetetraacetic acid.

For examples of some cleaning solutions and their uses see, e.g., U.S. Pat. No. 3,413,160 and U.S. Pat. Nos. Re. 30,796 and 30,714; the teachings of said references are incorporated herein by reference.

Cleaning solutions are employed predominantly in the removal of scale and rust from ferrous metals. However, the solutions often contact other metals which are present as an integral part of the system being cleaned. Examples of such metals include copper, copper alloys, zinc, zinc alloys and the like.

The corrosion inhibitor composition of the present invention advantageously is employed in an amount sufficient to inhibit acid-induced corrosion of metals which are in contact or contacted with an aqueous cleaning solution. Typically, the corrosion inhibitor composition of the present invention is employed in an amount sufficient to give a corrosion rate which is less than or equal to about 0.015 $lb/ft^2/day$. Preferably, from about 145 to about 2900 milligrams per liter of corrosion inhibitor, measured as the sum of the aliphatic pyridinium or quinolinium salt and the sulfur-containing compound, are employed in the cleaning solution, based on the total volume of the final inhibited cleaning solution. Preferably, the amount of the quaternary salt which is employed ranges from about 120 to about 2400 milligrams per liter, and the amount of sulfur-containing compound which is employed ranges from about 25 to about 500 milligrams per liter. The amount of corrosion inhibitor composition employed is dependent upon the composition of the specific cleaning solution to be inhibited. For example, the presence of hydroxyethyl ethylenediaminetriacetic acid in a cleaning solution requires a relatively large amount of corrosion inhibitor composition. Preferably, the corrosion inhibitor composition is dissolved or dispersed in the cleaning solution prior to contacting the cleaning solution and the metal to be cleaned.

The inhibitor composition is especially effective when employed with cleaning solutions formulated using tetraammonium ethylenediaminetetraacetic acid or a mixture of hydroxyacetic acid and formic acid, and it preferred to employ the inhibitor composition of the present invention in cleaning solutions which contain these compounds.

A unique feature of the corrosion inhibitor composition of the present invention is its enhanced solubility in cleaning solvents which contain ammonium salts of ethylenediaminetetraacetic acid (EDTA), such as tetraammonium EDTA and diammonium EDTA. Tetraammonium and diammonium EDTA are normally aqueous solutions which are about 40 to 48 percent active by weight as supplied by the manufacturer. These solutions are referred to as "concentrated" cleaning solvents. Before these concentrated solutions are used to clean a piece of equipment, they are diluted with water 4 to 20 fold. For economic reasons, the cleaning solvents are shipped as the concentrated solvents.

Prior to the present invention, corrosion inhibitors were essentially insoluble in effective amounts of concentrated EDTA chelant solvents. The inhibitors were usually injected into water already in the equipment to be cleaned, followed by the appropriate amount of concentrated solvent. The inhibitor formulation described in this invention is soluble in the concentrated EDTA solvents. The amount of inhibitor added is dictated by the system to be cleaned. The improved solubility of the corrosion inhibitor composition of this invention provides two advantages:

(1) A time-consuming water dilution step is eliminated; and (2) The solvent-inhibitor mixture can be prepared and transported as a concentrate in advance of the intended use.

The process of cleaning or removing predominantly iron oxide scale from metal surfaces involves contacting such scale encrusted surfaces with a cleaning solution inhibited against corrosion by the corrosion inhibitor composition of the present invention for a time sufficient to remove the desired amount of scale. As with most chemical reactions, the rate of scale dissolution is increased at higher temperatures. So while ambient temperatures can be used, the process is preferably conducted at an elevated temperature. The upper temperature is bounded only by the thermal stability of the essential components in the inhibited cleaning solution and by the capacity or ability of the corrosion inhibitor to function effectively at that temperature. Thus, process temperatures of from about 100° F. to about 325° F. are common. The reaction rate of scale dissolution is quite acceptable at the preferred temperatures. The cleaning process typically is conducted at atmospheric or superatmospheric pressures.

The aqueous cleaning solution is normally a liquid system but can be used as a foam. It is preferred to utilize liquid cleaning solutions in most instances. The cleaning solutions are employed in any known manner.

SPECIFIC EMBODIMENTS

The following examples and comparative experiments are illustrative of the present invention, but are not to be construed as limiting its scope. All parts and percentages are by weight unless otherwise specified.

PREPARATION 1

Preparation of Dodecyl Pyridinium Bromide

Equimolar amounts of 1-bromo-dodecane (249.2 g) and pyridine (79.1 g) are placed in a glass, three-necked, round bottom flask equipped with a heating means, a stirring means, and a condensing means. Then 82.1 g of isopropanol are added to the flask as a solvent. The contents of the vessel are heated to reflux with constant stirring. Reflux is maintained for six hours. Analysis of the reaction mixture indicates that the reaction is approximately 100 percent complete.

PREPARATION 2

Preparation of a Formulated Corrosion Inhibitor Composition

A homogeneous corrosion inhibitor is prepared by adding, with stirring, to a vessel the following components (in weight parts):

(a) 30 parts of the cooled reaction mixture of Preparation 1 (i.e., a mixture of 24 parts dodecyl pyridinium bromide and 6 parts isopropanol);

(b) 5 parts thiourea;

(c) 5 parts of the adduct of nonyl phenol and 15 moles of ethylene oxide;

(d) 12 parts isopropanol;

(e) 24 parts monobutyl ether of ethylene glycol; and (f) 24 parts water.

The composition has excellent weatherability, as indicated by its −10° F. freezing point.

GENERAL CORROSION RATE DETERMINATION PROCEDURE

The following variables are controlled:

(a) type of cleaning solution (active corrosive agent(s));

(b) concentration of cleaning agent(s);

(c) S/V ratio, i.e., the ratio of the exposed metal surface area of a test coupon to the volume of cleaning solution;

(d) type of metal; and (e) concentration of corrosion inhibitor.

Each test is performed by adding a cleaning solution, the amount of which is determined according to the desired S/V ratio, to a 450 ml glass vessel along with a measured amount of a corrosion inhibitor composition. Metal test coupons are cleaned, weighed, and submersed in the inhibited cleaning solution. The glass vessel is then placed inside a bomb, which in turn is immersed in a constant temperature bath for six hours, measured from the time at which the inhibited cleaning solution reaches the desired test temperature. Then, the bomb is removed from the bath, is cooled and emptied. The coupons are rinsed and reweighed. The corrosion rate is calculated by converting the weight loss to pounds/ft$^2$/day. The results of several Examples and Comparative Experiments are given in Table II.

TABLE II

| Run | Cleaning Solution* | Temperature (°F.) | S/V ($cm^{-1}$) | Metal** | Inhibitor+ | Inhibitor Concentration (vol. %) | Corrosion Rate (lb/ft$^2$/day) |
|---|---|---|---|---|---|---|---|
| C.E. 1 | A | 300 | 0.6 | CS | 1 | 0.1 | 0.006 |
| Ex. 1 | A | 300 | 0.6 | CS | 2 | 0.1 | 0.006 |
| C.E. 2 | A | 325 | 0.8 | CS | 1 | 0.2 | 0.013 |
| Ex. 2 | A | 325 | 0.8 | CS | 2 | 0.1 | 0.008 |
| C.E. 3 | A | 325 | 0.8 | BP | 1 | 0.2 | 0.016 |
| Ex. 3 | A | 325 | 0.8 | BP | 2 | 0.1 | 0.009 |
| C.E. 4 | A | 325 | 0.8 | TIA | 1 | 0.2 | 0.019 |
| Ex. 4 | A | 325 | 0.8 | TIA | 2 | 0.1 | 0.008 |
| C.E. 5 | B | 200 | 0.6 | CS | 1 | 0.1 | 0.0026 |
| Ex. 5 | B | 200 | 0.6 | CS | 2 | 0.1 | 0.002 |
| C.E. 6 | C | 200 | 1.3 | CS | 1 | 0.2 | 0.0023 |
| Ex. 6 | C | 200 | 1.3 | CS | 2 | 0.1 | 0.001 |

TABLE II-continued

| Run | Cleaning Solution* | Temperature (°F.) | S/V ($cm^{-1}$) | Metal** | Inhibitor+ | Inhibitor Concentration (vol. %) | Corrosion Rate ($lb/ft^2/day$) |
|---|---|---|---|---|---|---|---|
| C.E. 7 | C | 200 | 1.3 | T22 | 1 | 0.1 | 0.078 |
| Ex. 7 | C | 200 | 1.3 | T22 | 2 | 0.1 | 0.007 |
| C.E. 8 | D | 200 | 1.3 | CS | 1 | 0.1 | 0.002 |
| Ex. 8 | D | 200 | 1.3 | CS | 2 | 0.1 | 0.004 |
| C.E. 9 | D | 200 | 1.3 | T22 | 1 | 0.1 | 0.003 |
| Ex. 9 | D | 200 | 1.3 | T22 | 2 | 0.1 | 0.004 |
| C.E. 10 | D | 200 | 1.3 | BP | 1 | 0.1 | 0.002 |
| Ex. 10 | D | 200 | 1.3 | BP | 2 | 0.1 | 0.001 |
| Ex. 11 | A | 300 | 0.6 | CS | 5 | 0.2 | 0.047 |
| C.E. 11 | A | 300 | 0.6 | CS | 6 | 0.2 | 0.06 |
| Ex. 12 | A | 300 | 0.6 | CS | 3(8) | 0.1 | 0.025 |
| Ex. 13 | A | 300 | 0.6 | CS | 3(10) | 0.1 | 0.013 |
| Ex. 14 | A | 300 | 0.6 | CS | 3(12) | 0.1 | 0.007 |
| Ex. 15 | A | 300 | 0.6 | CS | 3(14) | 0.1 | 0.005 |
| Ex. 16 | A | 300 | 0.6 | CS | 3(16) | 0.1 | 0.005 |
| Ex. 17 | A | 300 | 0.6 | CS | 4 | 0.1 | 0.015 |

*The key to the cleaning solution employed in Table II is as follows:
Cleaning Solution A is a 4.68% aqueous tetraammonium EDTA solution.
Cleaning Solution B is a 3% aqueous solution of a mixture consisting of 3 parts of 70% aqueous hydroxyacetic acid per 1 part of 90% aqueous formic acid.
Cleaning Solution C is identical to Cleaning Solution B except that it additionally contains 0.25% dissolved ammonium bifluoride.
Cleaning Solution D is a 4.44% aqueous diammonium EDTA solution.
**The key to the metals employed in Table II is as follows: CS = 1018 carbon steel (ASTM Part 5, A29); BP = boiler plate, SA-515-GR70 (Metals Handbook, 9th Ed. V. 1, p. 138, American Society for Metals (1978)); TIA = low alloy steel, SA-209-TIA (ASTM Part 1, A209); T22 = low alloy steel, SA-213-T22 (ASTM Part 1, A199).
+The key to the corrosion inhibitor compositions employed in Table II is as follows: 1 = a commercial inhibitor available from Aquaness Chemical Company, a division of Magna Corporation under the tradename Cronox 240. 2 = the formulation of Preparation 2. 3(x) = a formulation consisting of: 25% quaternary alkyl pyridinium bromide, the alkyl chain having x carbon atoms; 25% thiourea; and 50% water. 4 = a formulation similar to inhibitor 3(x) except that the quaternary salt is octyl(3-ethyl pyridinium) bromide. 5 = dodecyl pyridinium bromide. 6 = Thiourea.

A review of the results listed in Table II leads to several interesting conclusions. It may be seen from Examples 1–10 and Comparative Experiments 1–10 that the dodecyl pyridinium bromide formulation of Preparation 2 provides protection which is often equal or better than the protection afforded by the commercial corrosion inhibitor composition employed in the comparative experiments. Surprisingly, in Examples 2–4 the inhibitor of the present invention provides better protection at a lower concentration as compared to the commercial inhibitor employed in Comparative Experiments 2–4.

Examples 12–16 demonstrate the effect of carbon chain length of the R-substituent of the pyridinium bromide.

Comparing Example 17 to Example 12 demonstrates that an ethyl substituent at the 3 position of the pyridine ring has a beneficial effect.

A comparison of Example 11 and Comparative Experiment 11 with Example 13 indicates that the combination of thiourea and dodecyl pyridinium bromide is more effective than either component by itself.

What is claimed is:

1. An aqueous cleaning solution composition having a pH of from about 1 to about 10, consisting essentially of at least one organic acid, selected from the group consisting of alkylene polyamine polyacetic acid, hydroxyacetic acid, formic acid, and citric acid, or a salt thereof, and further having dissolved or dispersed therein, in at least an amount sufficient to inhibit the corrosion of metals in contact with said solution, a corrosion inhibitor composition comprising:

(1) at least one of an aliphatic pyridinium salt or an aliphatic quinolinium salt; and (2) a sulfur-containing compound.

2. The composition of claim 1 wherein the salt of (1) is an alkyl pyridinium salt represented by the formula:

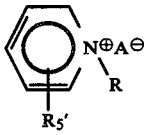

wherein R is alkyl; A⊖ is an anion; and each R' independently is H, —OH, —OR, —OROH, halo, alkyl, alkenyl, or alkynyl.

3. The composition of claim 2 wherein R is alkyl of from about 8 to about 18 carbon atoms and each R' is H.

4. The composition of claim 3 wherein R is dodecyl.

5. The composition of claim 1 further comprising at least one alcohol.

6. The composition of claim 1 wherein the sulfur-containing compound comprises ammonium thiocyanate.

7. The composition of claim 1 wherein the sulfur-containing compound comprises a compound having a thioamide moiety —$CSNH_2$.

8. The composition of claim 7 wherein the sulfur-containing compound comprises thiourea.

9. The composition of claim 1 wherein the pH of the cleaning solution ranges from about 2 to about 10.

10. The composition of claim 1 wherein said at least one organic acid includes at least one alklene polyamine polyacetic acid or salt thereof.

11. The composition of claim 1 wherein said at least one organic acid includes at least one alklene polyamine polyacetic acid or salt thereof selected from the group consisting of HEDTA, tetraammonium EDTA, and diammonium EDTA.

12. The composition of claim 1 wherein said at least one organic acid is HEDTA.

13. The composition of claim 1 wherein said at least one organic acid comprises at least one compound selected from the group consisting of citric acid, hydroxyacetic acid, and formic acid.

14. A process for removing hardness scale and one or more iron oxide-containing deposits from a metal surface containing one or more of said deposits and scale by contacting said metal surface with an aqueous cleaning solution composition of claim 1 for a time sufficient to dissolve said deposits and scale.

15. The composition of claim 2 further comprising at least one alcohol, and at least one alkylene polyamine polyacetic acid or salt thereof.

16. The composition of claim 15 wherein the sulfur-containing compound comprises at least one of thiourea or ammonium thiocyanate.

17. An inhibited aqueous cleaning solution composition having a pH of from about 1.2 to about 10 consisting essentially of:

(1) a cleaning agent comprising at least one organic acid, selected from the group consisting of alkylene polyamine polyacetic acid, hydroacetic acid, formic acid, and citric acid, or a salt thereof and, in at least an amount sufficient to inhibit the corrosion of metals which are in contact with said solution, (2) a corrosion inhibitor composition comprising a sulfur-containing compound and an alkyl pyridinium salt represented by the formula:

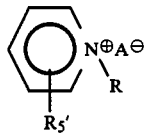

wherein R is alkyl; A⊖ is an anion; and each R' independently is H, —OH, —OR, —OROH, halo, alkyl, alkenyl, or alkynyl.

18. A composition of claim 17 wherein the cleaning agent comprises an alkylene polyamine polyacetic acid or a salt thereof.

19. A composition of claim 17 further comprising an alcohol, and a surfactant.

20. A composition of claim 19 containing from about 145 to about 2900 mg/l of corrosion inhibitor, measured as the sum of the weight of the aliphatic pyridinium salt and the sulfur-containing compound, based on the total volume of the final inhibited cleaning solution.

21. The composition of claim 17 wherein the cleaning agent includes at least one alkylene polyamine polyacetic acid or salt thereof selected from the group consisting of HEDTA, tetraammonium EDTA, and diammonium EDTA.

22. The composition of claim 17 wherein the cleaning agent is HEDTA.

* * * * *